US006830309B2

(12) United States Patent
Murakami

(10) Patent No.: US 6,830,309 B2
(45) Date of Patent: Dec. 14, 2004

(54) METHOD FOR MANUFACTURING INK JET RECORDING HEAD, INK JET RECORDING HEAD AND INK JET RECORDING METHOD

(75) Inventor: Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/945,796

(22) Filed: Sep. 5, 2001

(65) Prior Publication Data

US 2002/0054181 A1 May 9, 2002

(30) Foreign Application Priority Data

Sep. 6, 2000 (JP) ..... 2000/270225

(51) Int. Cl.[7] ..... B41J 29/393; B41J 2/14
(52) U.S. Cl. ..... 347/19; 347/14
(58) Field of Search ..... 347/14, 19, 47

(56) References Cited

U.S. PATENT DOCUMENTS

| | | | | |
|---|---|---|---|---|
| 4,550,326 A | * | 10/1985 | Allen et al. | 347/47 |
| 4,565,859 A | | 1/1986 | Murai et al. | 528/365 |
| 5,812,156 A | * | 9/1998 | Bullock et al. | 347/19 |
| 5,924,197 A | | 7/1999 | Murakami et al. | 29/890.1 |
| 6,036,297 A | * | 3/2000 | Hayasaki | 347/19 |
| 6,089,694 A | | 7/2000 | Murakami | 347/34 |
| 6,109,718 A | | 8/2000 | Murakami et al. | 347/14 |
| 6,137,510 A | | 10/2000 | Sato et al. | 347/63 |
| 6,143,190 A | | 11/2000 | Yagi et al. | 216/27 |
| 6,186,616 B1 | | 2/2001 | Inoue et al. | 347/45 |
| 6,190,005 B1 | | 2/2001 | Murakami | 347/65 |
| 6,286,933 B1 | | 9/2001 | Murakami et al. | 347/47 |

FOREIGN PATENT DOCUMENTS

| | | | | |
|---|---|---|---|---|
| JP | 60-161973 | | 8/1985 | |
| JP | 63-221121 | | 9/1988 | |
| JP | 64-9216 | | 1/1989 | |
| JP | 2-140219 | | 5/1990 | |
| JP | 4043326949 A | * | 11/1992 | 347/19 |
| JP | 10-181032 | | 7/1998 | |

OTHER PUBLICATIONS

Crivello, J.V., et al., "New Photoinitiators for Cationic Polymerization," Journal of Polymer Science: Symposium, No. 56 (1976), pp. 383–395.

* cited by examiner

*Primary Examiner*—Stephen D. Meier
*Assistant Examiner*—Julian D. Huffman
(74) *Attorney, Agent, or Firm*—Fitzpatrick, Cella, Harper & Scinto

(57) ABSTRACT

A method for manufacturing an ink jet recording head including a plurality of ink flow paths, a plurality of energy generating elements provided in the respective ink flow paths, and a plurality of discharge ports communicated with the respective ink flow paths. The discharge ports are formed by patterning. The method includes a measuring step for measuring a discharge port area (an opening area of the discharge port), a step for determining a discharge amount rank (indicating a discharge amount) on the basis of a relationship between a discharge port area and the ink discharge amount, and a step for writing at least one of the discharge port area, the ink discharge amount having the relationship to the discharge port area, and the discharge amount rank, on a memory mounted to the ink jet recording head.

6 Claims, 11 Drawing Sheets

METHOD FOR MANUFACTURING INK JET RECORDING HEAD, INK JET RECORDING HEAD AND INK JET RECORDING METHOD

BACKGROUND OF THE INVENTION

1. Field of the Invention

The present invention relates to a method for manufacturing an ink jet recording head, an ink jet recording head, and an ink jet recording method.

2. Related Background Art

Among ink discharging methods of ink jet recording systems which have widely been used, there are a method in which electrical/thermal converting elements (heaters) are used as discharge energy generating means used for discharging ink droplets and a method in which piezo-electric elements are used. In these methods, discharging of the ink droplet can be controlled by an electrical signal. For example, the ink droplet discharging method utilizing the electrical/thermal converting element is based on the principle according to which ink near the electrical/thermal converting element is instantaneously boiled by applying the electrical signal to the electrical/thermal converting element and abrupt growth of a bubble created by phase change in the ink causes the ink droplet to discharge at a high speed. On the other hand, the ink droplet discharging method utilizing the piezo-electric element is based on the principle in which the piezo-electric element is displaced by applying the electrical signal to the piezo-electric element and pressure generated by such displacement causes the ink droplet to discharge.

In such an ink jet recording head, there arose a problem that an amount of the ink droplet to be discharged varied from head to head due to variation in manufacture and, thus, printing density varied from ink jet recording head to ink jet recording head.

To solve such a problem, there has been proposed a method in which, during a manufacturing process of the ink jet recording head, ink is actually discharged against a sheet of paper or an exclusive recording medium to from an ink dot, a discharge amount is calculated on the basis of a diameter of the dot, such discharge amount information is stored in a memory mounted to the ink jet recording head, and the discharge amount of the ink jet recording head or an amount of ink applied to the image is changed in accordance with the discharge amount information.

However, in the attempt to suppress the variation in ink discharge amount from head to head in the above-mentioned conventional ink jet recording head, there arose the following problems.

That is to say, in the above-mentioned conventional methods, variation in ink dot diameter occurs due to variation in thickness of an ink receiving layer or in ink permeation/spreading into the receiving layer for each lot of recording media or each recording medium, thereby increasing an error in calculation of the discharge amount.

Further, in the ink jet recording head of the so-called bubble jet type utilizing the electrical/thermal converting elements, since the head itself has a tendency that the discharge amount varies with temperature, in order to measure the discharge amount accurately, the dot diameter must be measured while effecting temperature control with high accuracy, thereby making the recording apparatus and equipment bulky and increasing the cost.

Furthermore, if a size of the liquid droplet itself becomes small, for example, 5 pl, the dot diameter itself is decreased to about 50 $\mu$m, then variation in dot diameter measurement exerts a great influence upon the calculation of the discharge amount.

As discussed above, in the technique in which the discharge amount is calculated by effecting the actual discharging/recording, problems arose regarding the accuracy and the cost of the apparatus.

SUMMARY OF THE INVENTION

Therefore, an object of the present invention is to provide a method for manufacturing an ink jet recording head, and an ink jet recording head, in which individual differences in discharge amount between respective ink jet recording heads can be measured without actually discharging ink.

To achieve the above object, the present invention provides a method for manufacturing an ink jet recording head comprising a plurality of ink flow paths to which ink is supplied externally, a plurality of energy generating elements provided in the respective ink flow paths and adapted to generate energy utilized for discharging the ink, and a plurality of discharge ports communicated with the respective ink flow paths, and in which the discharge ports are formed by patterning, the method comprising a measuring step for measuring a discharge port area which is an opening area of the discharge port, a step for determining a discharge amount rank which is an index indicating a quantity of the discharge amount (—the discharge amount being subject to variation across different ink jet recording heads due to individual differences between the heads) on the basis of a relationship between the discharge port area and the ink discharge amount, and a step for writing discharge amount information including at least one of the discharge port area, the ink discharge amount having the relationship to the discharge port area, and the discharge amount rank, on a memory mounted to the ink jet recording head.

As mentioned above, in the method for manufacturing the ink jet recording head according to the present invention, since the discharge amount information, including at least one of the discharge port area, the ink discharge amount having the relationship to the discharge port area, and the discharge amount rank as the index for indicating the quantity of the discharge amount (accounting for the individual difference of the recording head) on the basis of the relationship between the discharge port area and the ink discharge amount, is written in the memory mounted to the ink jet recording head, the ink discharge amount of the ink jet recording head (taking into account the individual difference due to variation in manufacture) can be given to the ink jet recording head as the discharge amount information.

Further, the discharge port area may be an opening area of a dummy discharge port which does not contribute to the ink discharging.

In addition, the measuring step may be performed for each manufacturing lot of ink jet recording heads. In this case, since measurement of all of the discharge port areas of the ink jet recording heads is not required, not only can the measuring time be shortened, but also the working can be simplified.

Incidentally, the measuring step may be performed for each ink jet recording head to be manufactured.

The shape of the discharge ports which contribute to ink discharging may be a shape other than a circular shape, and the shape of the dummy discharge port(s) may be a circular shape.

With the arrangement as mentioned above, since the head has a memory in which the discharge amount information, including at least one of the discharge port area, the ink discharge amount having the relationship to the discharge port area, and the discharge amount rank as the index for indicating the quantity of the discharge amount (accounting for the individual difference of the recording head) on the basis of the relationship between the discharge port area and the ink discharge amount, is written, the head can have the ink discharge amount of the ink jet recording head (taking into account the individual difference due to variation in manufacture) as the discharge amount information. Further, when the shape of the dummy discharge port is circular, not only can the measurement of the discharge port area be facilitated, but also the shape of the discharge port from which the ink is actually to be discharged can be designed to be a shape suitable for discharging the ink.

Further, the opening area of the dummy discharge port(s) may be greater than the opening area of the discharge ports which contribute to the ink discharging. The smaller the discharge volume, the smaller the opening area of the discharge ports which contribute to the ink discharging, and, thus, the smaller the discharge port area, and the greater the error due to the measuring resolving power. However, by measuring the dummy discharge port having the greater opening area, the discharge port area can be measured more easily and correctly.

In the ink jet recording head manufactured by the ink jet recording head manufacturing method according to the present invention, since the head has a memory in which the discharge amount information, including at least one of the discharge port area, the ink discharge amount having the relationship to the discharge port area, and the discharge amount rank as the index for indicating the quantity of the discharge amount (accounting for the individual difference of the recording head) on the basis of the relationship between the discharge port area and the ink discharge amount, is written, the head can have the ink discharge amount of the ink jet recording head (taking into account the individual difference due to variation in manufacture) as the discharge amount information.

An ink jet recording method according to the present invention is performed by the ink jet recording head according to the present invention and is characterized in that ink is discharged by communicating a bubble with the atmosphere.

In the ink jet recording method according to the present invention having the above-mentioned feature, since the discharge amount information, including at least one of the discharge port area, the ink discharge amount having the relationship to the discharge port area, and the discharge amount rank as the index for indicating the quantity of the discharge amount (accounting for the individual difference of the recording head) on the basis of the relationship between the discharge port area and the ink discharge amount, is written in the memory mounted to the ink jet recording head, by sending a discharge signal corresponding to the individual difference, variation in recording density due to the individual differences in the discharge amount can be reduced. Further, by discharging the ink by communicating the bubble with the atmosphere, all the ink disposed between the energy generating element and the discharge port can be discharged positively, thereby stabilizing the ink discharge amount.

DETAILED DESCRIPTION OF THE PREFERRED EMBODIMENTS

Now, embodiments of the present invention will be explained with reference to the accompanying drawings.

Figure 1:
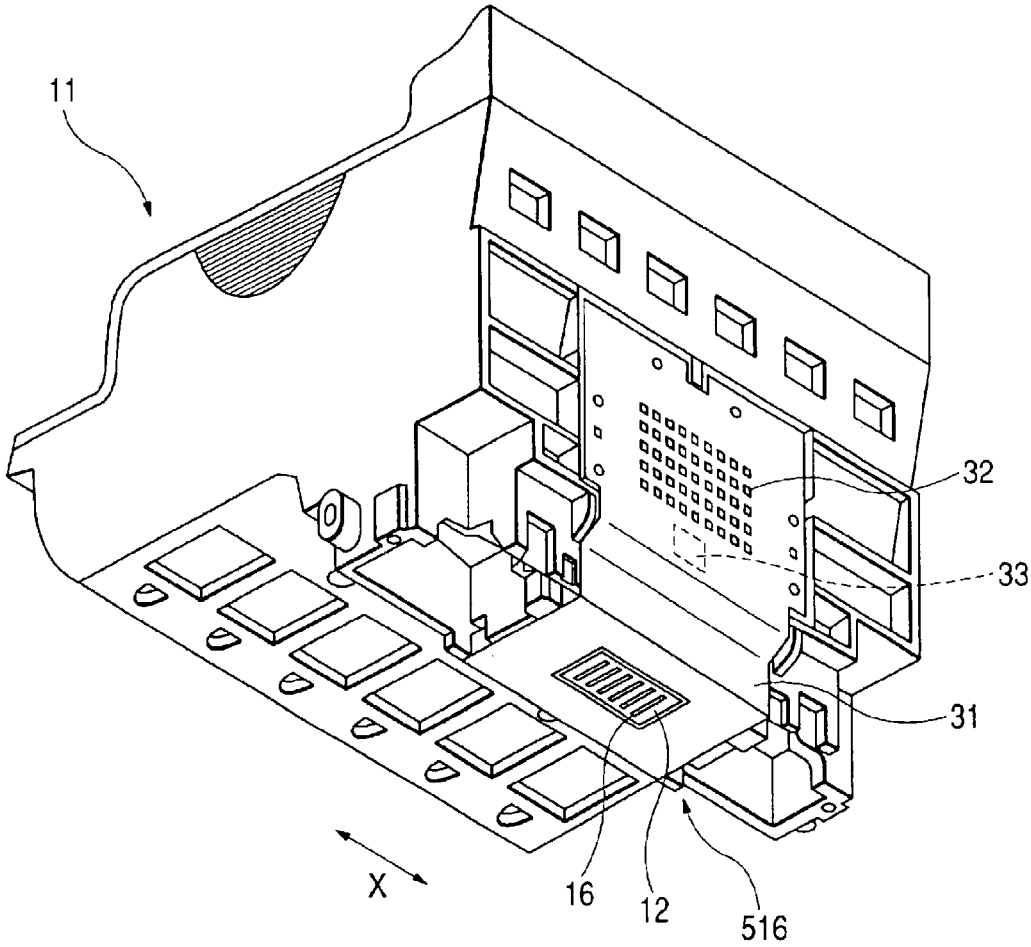
FIG. 1 is a perspective view showing an ink jet recording head according to an embodiment of the present invention.

FIG. 1 is a perspective view of a recording head cartridge, showing a fundamental embodiment of the present invention.

As shown in FIG. 1, a recording head cartridge 11 detachably mounted to an ink jet recording apparatus (not shown) and reciprocally shifted in the X directions includes an ink jet recording head 516 having a recording element substrate 12 in which a plurality of discharge ports 16 for discharging ink are formed. Further, the recording head cartridge 11 detachably mounts thereon ink tanks (not shown) for supplying the ink to the recording element substrate 12. In the recording head cartridge 11 according to the illustrated embodiment, six ink tanks containing six different color inks can be mounted. Incidentally, the six color inks may include color inks other than black and a black color ink.

An electrical wiring tape 31 serves to apply an electrical signal for discharging the ink from the recording element substrate 12 and is provided with an opening portion into which the recording element substrate 12 is incorporated, an element substrate electrode terminal corresponding to an electrode portion of the recording element substrate 12, and an external signal inputting terminal 32 for receiving an electrical signal from a main body of the apparatus, and an EEPROM (electrically erasable programable read only memory) 33 is mounted on a back surface of the tape. The EEPROM 33 is a ROM in which stored data can be erased electrically, and the data stored in the ROM is held or maintained even when a power supply of the apparatus itself is turned OFF. In the illustrated embodiment, a discharge amount rank (described later) of the recording element substrate 12 is stored in the ROM.

Figure 2:
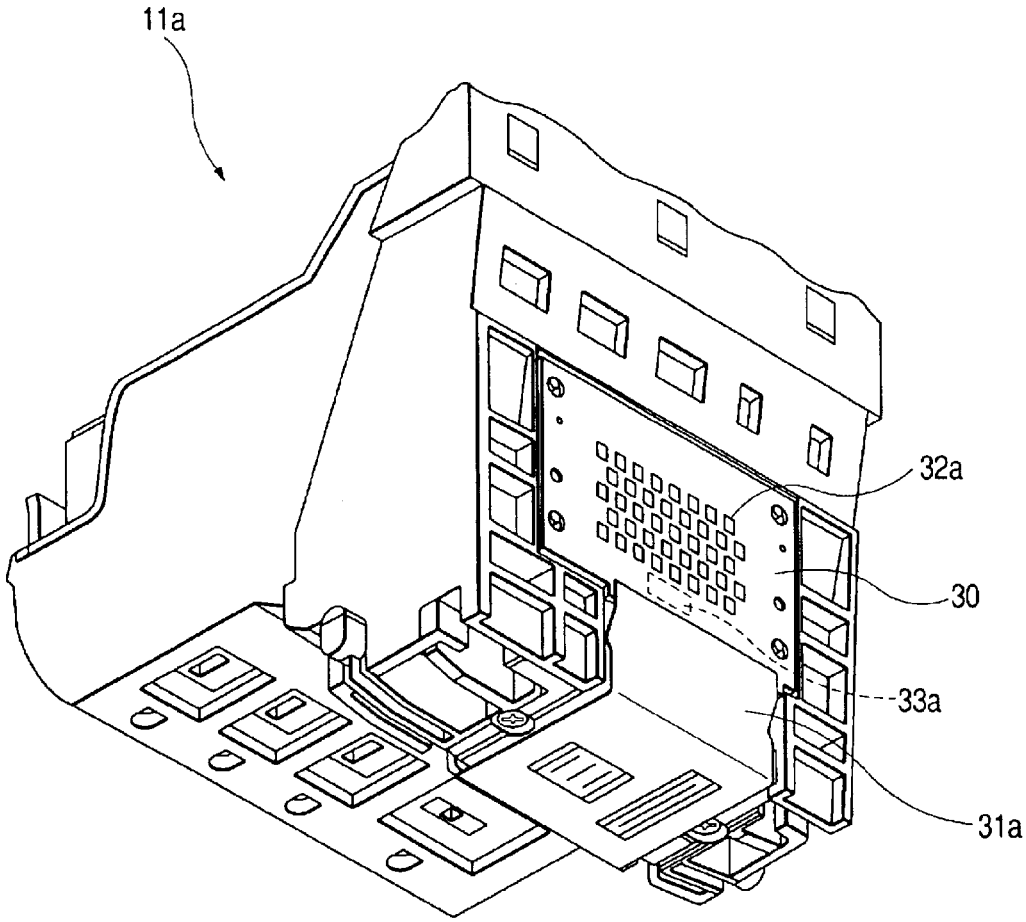
FIG. 2 is a perspective view showing an ink jet recording head according to another embodiment of the present invention.

Incidentally, as is the case in a recording head cartridge 11*a* shown in FIG. 2, in an arrangement in which an external signal input terminal 32*a* is provided on an electrical contact substrate 30 electrically connected to an electrical wiring tape 31*a* and different from the electrical wiring tape 31*a*, the EEPROM 33 may be provided on a back surface of the electrical contact substrate 30.

Figure 3:
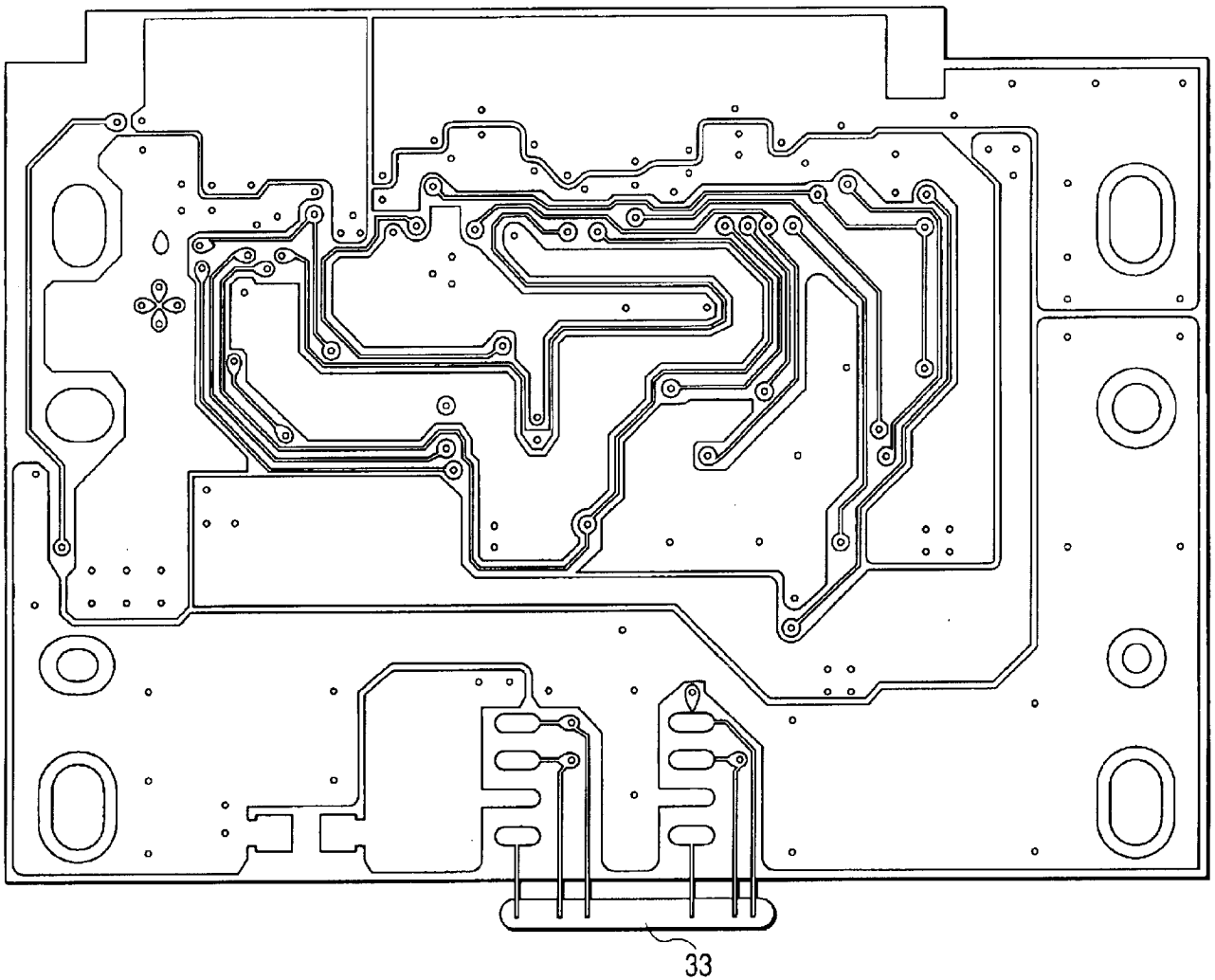
FIG. 3 is a view showing a wiring pattern layer on an electrical contact substrate.
Figure 4:
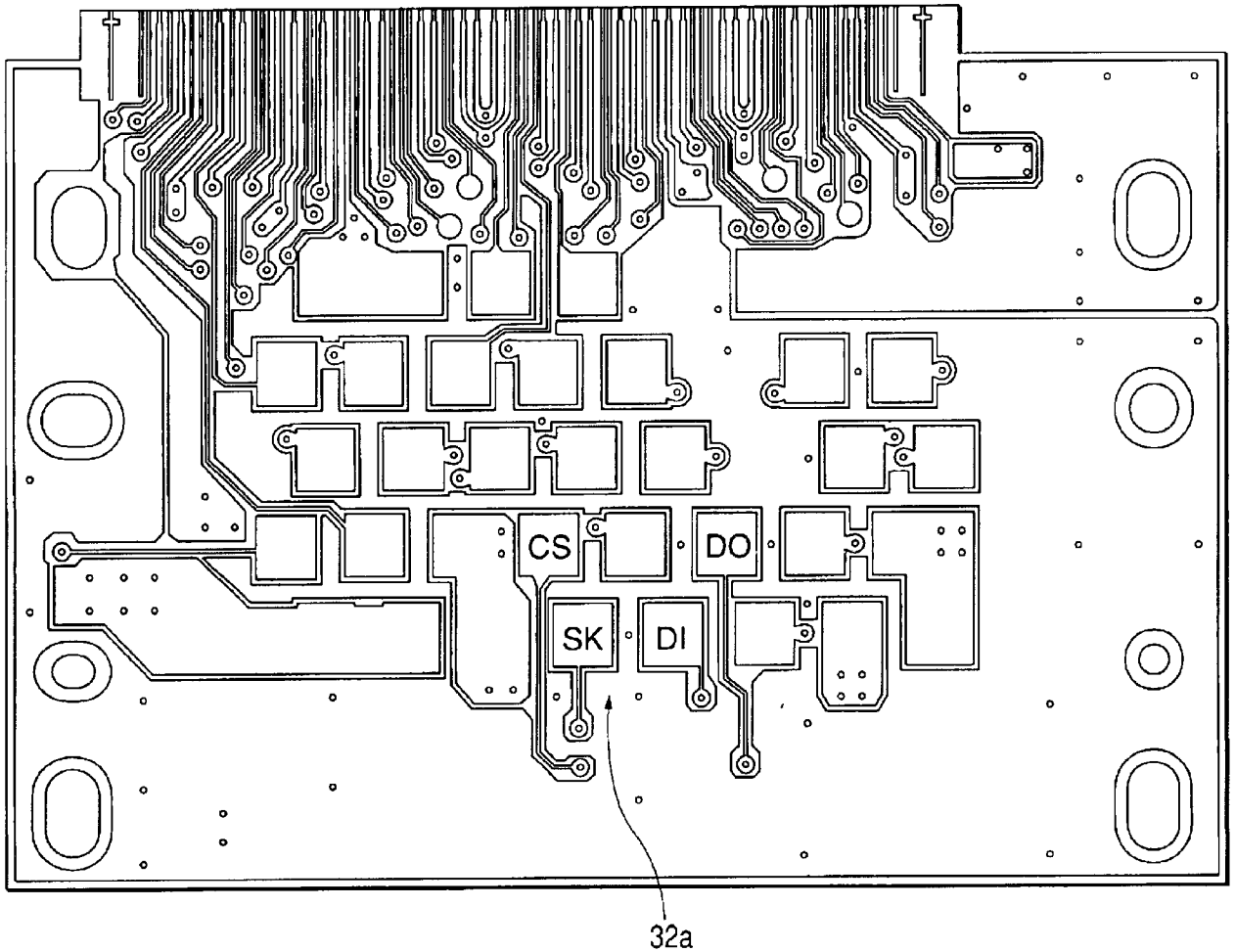
FIG. 4 is a view showing a wiring pattern layer different from the wiring pattern layer of FIG. 3, on the electrical contact substrate.

FIG. 3 shows a wiring pattern layer of the electrical contact substrate 30, and FIG. 4 shows a wiring pattern layer different from that shown in FIG. 3. The EEPROM 33 is electrically connected to a section shown in FIG. 3. Further, as shown in FIG. 4, the electrical contact substrate 30 is provided with four external signal input terminals (CS, SK, DO, DI) 32*a* for inputs/outputs of the EEPROM 33.

In this way, although the EEPROM 33 may be mounted on the recording head cartridge shown in FIG. 1 or shown in FIG. 2, the explanation described hereinbelow will be made by using the recording head cartridge 11 shown in FIG. 1.

Figure 12:
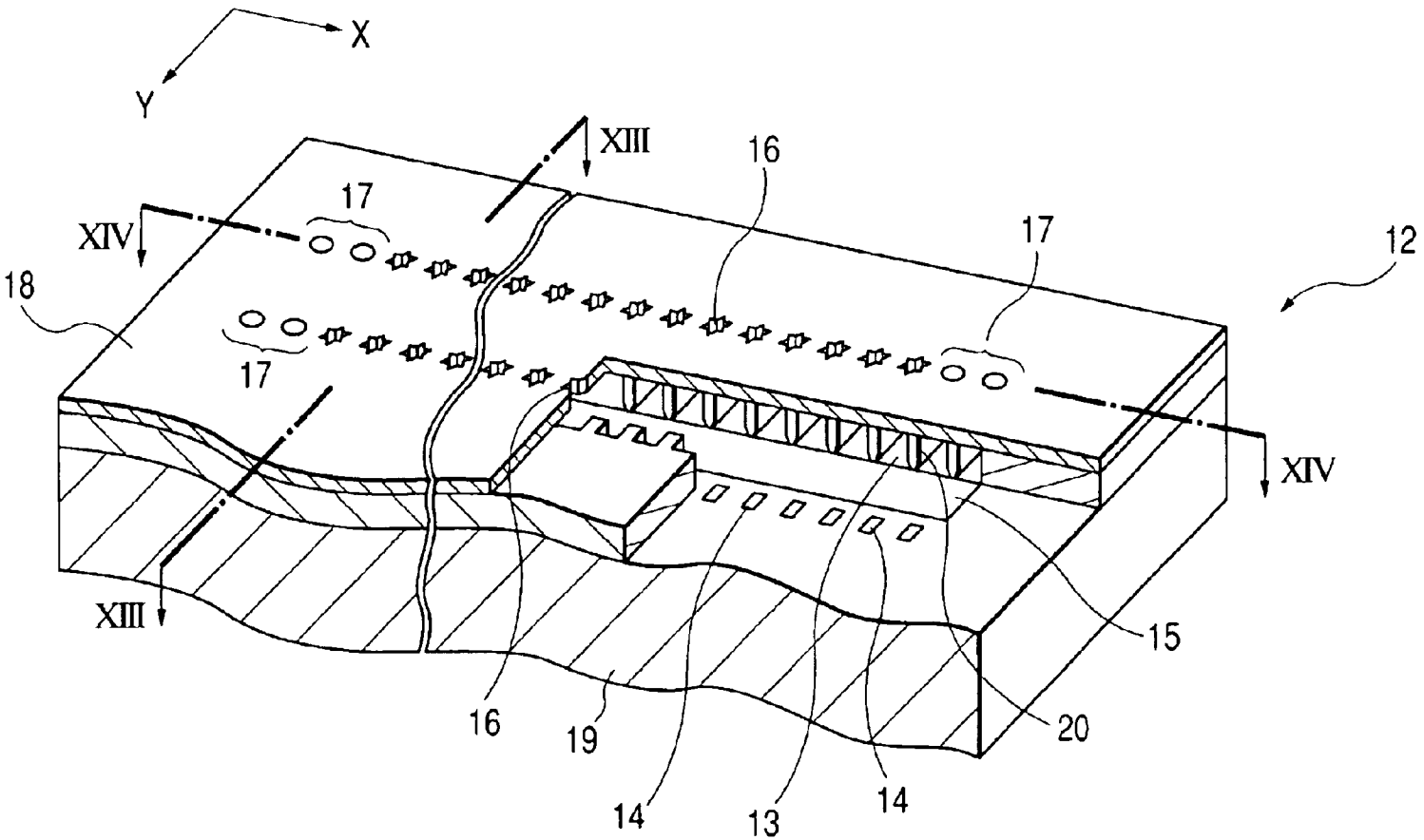
FIG. 12 is a perspective view, partially in section, showing a recording element substrate provided in the ink jet recording head of FIG. 1.
Figure 13:
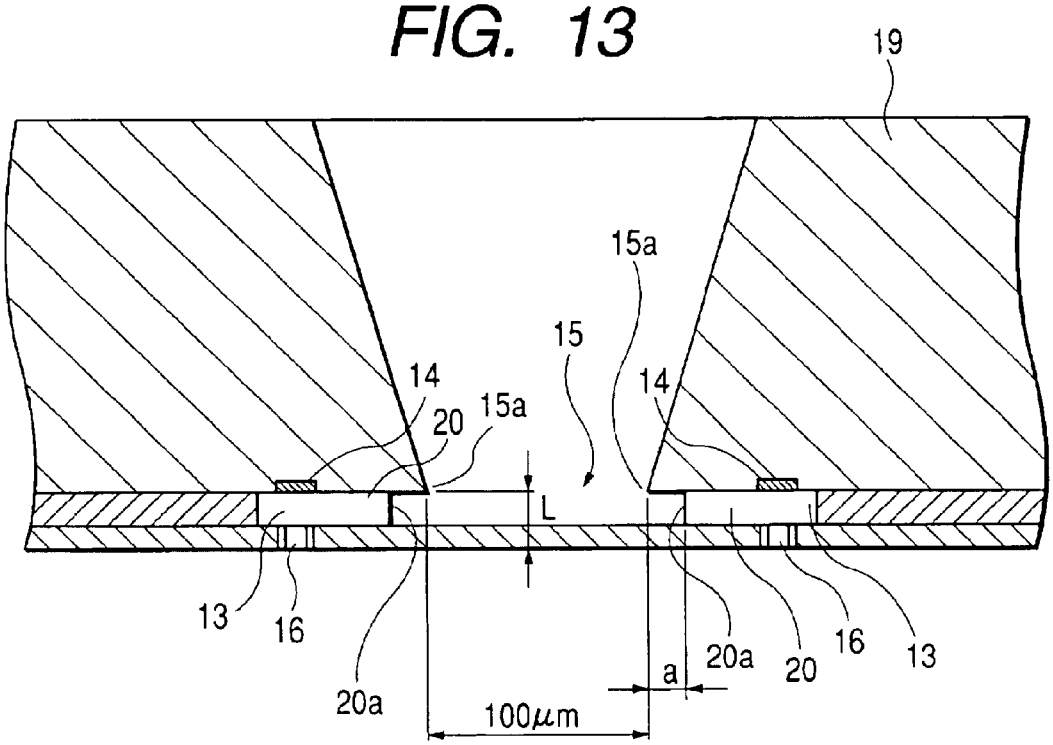
FIG. 13 is a partial sectional view of the recording element substrate, taken along the line XIII—XIII in FIG. 12.
Figure 14:
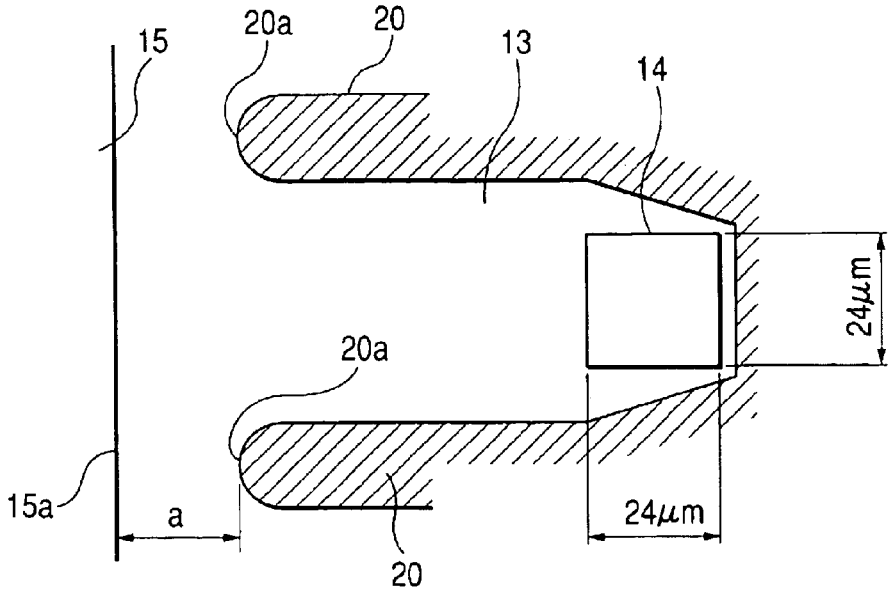
FIG. 14 is a partial plan view showing the vicinity of an electrical/thermal converting element, viewed from a direction shown by the arrows XIV in FIG. 12.

FIG. 12 is a schematic perspective view, partially in section, showing a recording element substrate for effecting ink discharging, provided in the ink jet recording head of FIG. 1. Further, FIG. 13 is a partial sectional view of the recording element substrate 12, taken along the line XIII—XIII in FIG. 12, and FIG. 14 is a partial plan view showing the vicinity of an electrical/thermal converting element 14, viewed from a direction shown by the arrows XIV in FIG. 12.

As shown in FIG. 12, the recording element substrate 12 is formed of, for example, an Si substrate 19 having a thickness of 0.625 mm. Further, ink supply ports 15 comprised of elongated groove-shaped through openings for supplying the ink are provided, and, a row of electrical/thermal converting elements 14 are disposed at each side of each ink supply port 15 in a staggered fashion. Incidentally, FIG. 12 shows only ink supply port 15 and electrical/thermal converting elements 14 corresponding to one color among six colors.

The electrical/thermal converting elements 14 and an aluminium electrical wiring for supplying electrical power to the electrical/thermal converting elements 14 are formed by a film-forming technique. Further, an electrode portion (not shown) for supplying the electric power to the electrical wiring is provided with a bump made of gold. The ink supply ports 15 are formed by anisotropic etching, by taking advantage of the crystal orientation of the Si substrate 19. When there is crystal orientation of <100> on a surface of a wafer and <111> in a thickness direction, the etching is anisotropic etching of an alkaline system (KOH, TMAH, hydrazine or the like). By using this method, a desired depth is etched. Alternatively, the ink supply ports 15 may be formed by an AE-POLY system disclosed in Japanese Patent Application Laid-open No. 10-181032. In the case of such an AE-POLY system, the ink supply ports 15 can be formed with high accuracy. Thus, this system is preferable.

Ink flow path walls 20 for defining ink flow paths 13 corresponding to the electrical/thermal converting elements 14, discharge ports 16 contributing to the ink discharging, and dummy discharge ports 17 which do not contribute to the ink discharging are formed on the Si substrate 19 by a photolithographic technique, thereby forming twelve discharge port rows corresponding to the six color inks.

Next, the formation of the discharge ports by means of the photolithographic technique will be more fully described.

Figure 5A:
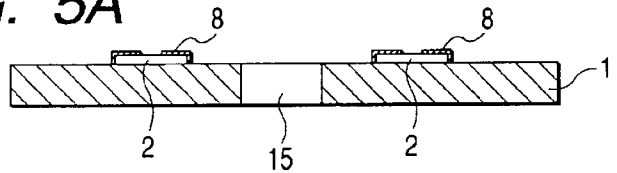
FIGS. 5A and 5B are schematic views showing the substrate before ink flow paths and an orifice portion are formed.
Figure 5B:
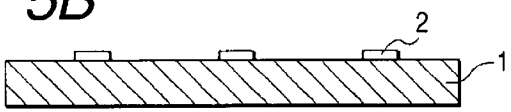

FIGS. 5A, 5B, 6A, 6B, 7A, 7B, 8A, BB, 9A, 9B, 10A, 10B, 11A and 11B are schematic views showing a construction of an ink jet recording head and a manufacturing method, according to a fundamental embodiment of the present invention. Incidentally, FIGS. 5A to 11A are schematic sectional views taken along the line XIII—XIII in FIG. 12, and FIGS. 5B to 11B are schematic sectional views taken along the line XIV—XIV in FIG. 12, First of all, in this embodiment, for example, as shown in FIGS. 5A and 5B, a substrate 1 made of glass, ceramic, plastic or metal is used.

The shape and material of such a substrate 1 are not particularly limited, so long as the substrate can act as a part of the liquid flow path constituting member and can act as a support for supporting a material layers in which the ink flow paths and the discharge ports are formed, which will be described later. A desired number of ink discharge energy generating elements 2 such as electrical/thermal converting elements or piezo-electric elements are disposed on the substrate 1. Discharging energy for discharging small recording liquid droplets is applied to the ink liquid by the ink discharge energy generating element 2, thereby effecting the recording. Incidentally, for example, when the electrical/thermal converting element is used as the ink discharge energy generating element 2, a change in state of the recording liquid (ink) in the vicinity of the ink discharge energy generating element occurs by heating the recording liquid by means of such elements, thereby generating the discharge energy. On the other hand, for example, when the piezo-electric element is used, the discharge energy is generated by mechanical vibration of this element.

Incidentally, an electrode 8 for inputting a control signal to operate the ink discharge energy generating element is connected to each element 2. Further, generally, as various function layers, such as a protection layer, are commonly provided in order to enhance the endurance of the discharge energy generating elements, also in the present invention, such function layers may be provided.

In FIGS. 5A and 5B, an example in which the opening portion constituting the ink supply port 15 is previously formed in the substrate 1 to supply the ink from the rearward of the substrate is illustrated. In the formation of the ink supply port 15, any means can be used so long as a hole can be formed in the substrate 1 by such means. For example, the port may be formed by mechanical means such as a drill, or optical energy such as laser may be used. Further, the port may be formed by patterning a resist pattern on the substrate 1 and then effecting chemical etching.

Of course, the ink supply port 15 need not be formed in the substrate 1 but may be formed in a resin pattern which may in turn be provided on the same surface as the ink discharge ports with respect to the substrate 1.

Figure 6A:
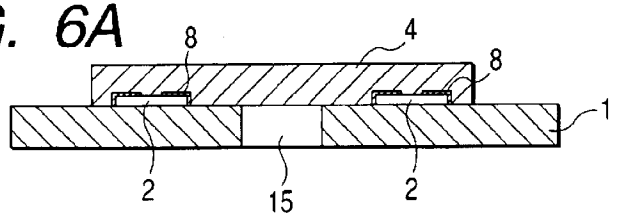
FIGS. 6A and 6B are schematic views showing the substrate on which a soluble ink flow path pattern has been formed.
Figure 6B:
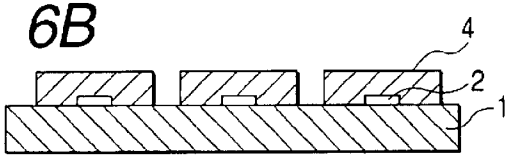

Then, as shown in FIGS. 6A and 6B, ink flow path patterns 4 made of soluble resin are formed on the substrate 1 including the ink discharge energy generating elements 2. Although the patterns can be formed by a photosensitive material as the most common means, the pattern can also be formed by means such as a screen printing method. When a photosensitive material is used, since the ink flow path patterns are soluble, a positive type resist or a positive type resist of the solution-change type may be used.

As a method for forming the resist layer, when the substrate having the ink supply ports is used, it is preferable that the photosensitive material is dissolved in a suitable solvent, and the solution is coated on a film such as PET and is dried to form a dried film, and the layer is formed by laminating such a film. The dried film may preferably be formed from a photodecay polymer compound of a vinyl ketone group such as polymethyl isopropyl ketone or polyvinyl ketone. The reason is that such a compound maintains a property (coating ability) as a polymer compound prior to light illumination and can easily be laminated on the ink supply port 15.

Further, the film may be formed by disposing a filler which can be removed in a post-process within the ink supply port 15 and then effecting a normal spin-coating method or roll-coating method.

Figure 7A:
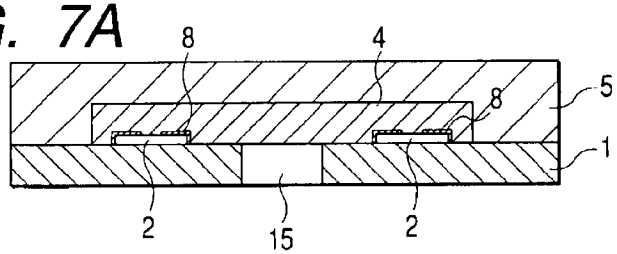
FIGS. 7A and 7B are schematic views showing the substrate on which a coating resin layer has been formed.
Figure 7B:
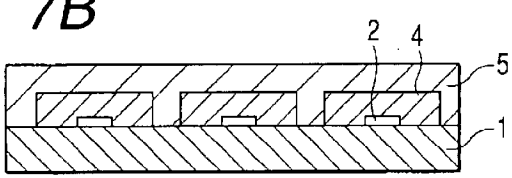

In this way, as shown in FIGS. 7A and 7B, a coating resin layer 5 is formed on the soluble resin material layers 4 for patterning the ink flow paths by means of a normal spin-coating method of roll-coating method. Here, in the process for forming the resin layer 5, it is required that the soluble resin patterns are not deformed. That is to say, when the coating resin layer 5 is dissolved in the solvent and then the solution is coated on the soluble resin patterns 4 by the spin-coating method or roll-coating method, a solvent must be selected that does not dissolve the soluble resin patterns 4.

Next, the coating resin layer 5 used in the illustrated embodiment will be explained. The coating resin layer 5 is preferably photosensitive since the ink discharge ports 3 can easily be formed with high accuracy by photolithography. Such a photosensitive coating resin layer 5 must have high mechanical strength as a structural material, good adhering ability to the substrate 1, ink-proof ability, and resolving power for patterning the minute patterns of the ink discharge ports. To this end, a cationic polymerization cured substance of epoxy resin has excellent strength as a structural material, good adhering ability and good ink-proof ability, and the epoxy resin has excellent patterning ability so long as it is in solid form at room temperature.

First of all, since the cationic polymerization cured substance of the epoxy resin has a higher bridging density (high Tg) in comparison with a normal cured substance of an acid anhydride or amine, it possesses excellent properties as a structural member. Further, by using the epoxy resin which has a solid form at room temperature, diffusion of polymerization starting species generated from a cation polymerization starting agent by light illumination onto the epoxy resin can be suppressed, thereby obtaining excellent patterning accuracy and patterning shape.

In the process for forming the coating resin layer on the soluble resin layers, it is desirable that the coating resin having a solid form at room temperature be dissolved in solvent and the coating resin layer be formed by coating the solution by means of a spin-coating method.

By using a spin-coating method, which is a film coating technique, the coating resin layer 5 can uniformly be formed with high accuracy, and a distance between the ink discharge energy generating element 2 and the orifice can be shortened (this was difficult to achieve using the conventional techniques), thereby achieving small liquid droplet discharging easily.

In order to flatly form the coating resin layer 5 on the soluble resin layers 4, prior to spin-coating, by dissolving the coating resin into the solvent at density of 30 to 70 mass % of solvent, more preferably, at density of 40 to 60 mass %, the surface of the coating resin layer 5 can be flattened.

As the solid epoxy resin used in the illustrated embodiment, a reactant between bisphenol A and epichlorohydrin and having molecular weight of 900 or more, a reactant between bromoth-containing phenol A and epichlorohydrin, a reactant between phenol novolac or o-cresol novolac and epichlorohydrin, or a multifunctional epoxy resin having an oxycyclohexane structure as disclosed in Japanese Patent Application Laid-open Nos. 60-161973, 63-221121, 64-9216 and 2-140219 may be used.

As the light cation polymerization starting agent for curing the epoxy resin, aromatic iodonium salt, aromatic sulfonium salt (refer to J. POLYMER SCI: Symposium No. 56 P. 383–395 (1976)) or SP-150 or SP-170 available from Asahi Kasei Kogyo Co., Ltd. may be used.

Figure 8A:
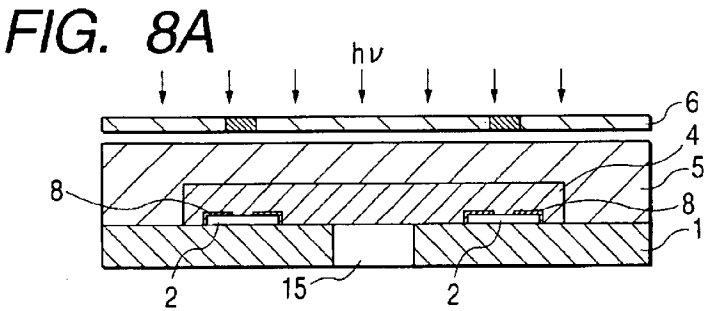
FIGS. 8A and 8B are schematic views showing the substrate on which pattern exposure for ink discharge ports is being effected on the coating resin layer.
Figure 8B:
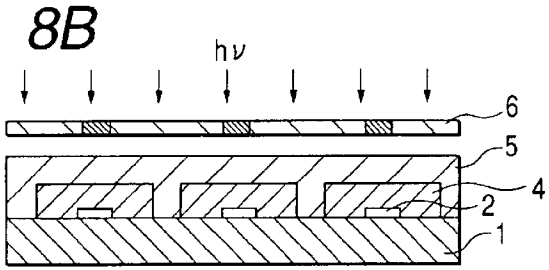

Then, as shown in FIGS. 8A and 8B, pattern exposure is performed on the photosensitive coating resin layer 5 comprised of a compound through a mask 6. The photosensitive coating resin layer 5 in the illustrated embodiment is of the negative type, and areas of the layer in which the ink discharge ports are to be formed are shielded by the mask (of course, areas for electrical connection are also shielded; not shown).

In the pattern exposure, in accordance with the photosensitive area of the light cation polymerzation starting agent used, an ultraviolet ray, deep-UV light, electron beam or X-ray can appropriately be selected.

In the previous processes, alignment can be effected by using a photolithographic technique, and thus, accuracy can be considerably improved in comparison with a technique in which the orifice plate is manufactured independently and is adhered to the substrate. If necessary, the photosensitive coating resin layer 5 subjected to the pattern exposure may be subjected to heat treatment in order to accelerate the reaction. As mentioned above, the photosensitive coating resin layer 5 is constituted by an epoxy resin having a solid form at room temperature, and the diffusion of the cation polymerization starting species caused by the pattern exposure is limited or regulated, thereby realizing excellent patterning accuracy and shape.

Figure 9A:
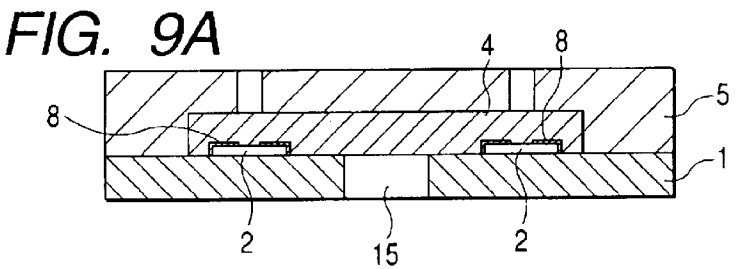
FIGS. 9A and 9B are schematic views showing the substrate in which the patterned coating resin layer has been developed.
Figure 9B:
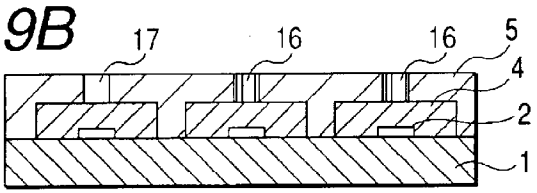
Figure 10A:
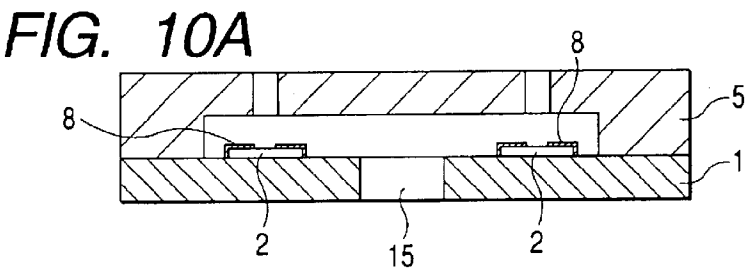
FIGS. 10A and 10B are schematic views showing the substrate from which the soluble resin pattern has been removed.
Figure 10B:
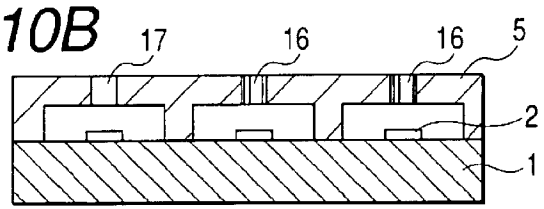

Then, as shown in FIGS. 9A and 9B, the photosensitive coating resin layer 5 subjected to the pattern exposure is developed by using an appropriate solvent, thereby forming the ink discharge ports. In this case, the soluble resin patterns 4 for forming the ink flow paths can be developed simultaneously with the development of the non-exposed photosensitive coating resin layer. However, in general, since plural identical or different heads are arranged on the substrate 1 and the heads are used as the ink jet recording heads through a cutting process, in order to achieve a countermeasure against dust generated in the cutting process, as shown in FIGS. 9A and 9B, by selectively developing only the photosensitive coating resin layer 5, the resin patterns 4 for forming the ink flow paths remain as they are (since the resin patterns 4 remain in the liquid chamber, the dust generated in the cutting process does not enter into the liquid chamber 9, and the resin patterns 4 may be developed after the cutting process (FIGS. 10A and 10B)). Further, in this case, since scum (developing residue) generated in the development of the photosensitive coating resin layer 5 is dissolved together with the soluble resin layers 4, there is no residue in the nozzles.

As mentioned above, when it is required to increase the bridging density, thereafter, post-curing is effected by dipping the photosensitive coating resin layer 5 in which the ink flow paths and the ink discharge ports were formed into a solution including a reducing agent and heating the layer. As a result, the bridging density of the photosensitive coating resin layer 5 is further increased, and good adhering ability to the substrate and good ink-proof ability can be obtained. Of course, the process for dipping the layer into the solution containing copper ions and for heating the layer may be performed immediately after the photosensitive coating resin layer 5 is subjected to the pattern exposure and the ink discharge ports are formed by developing, and, thereafter, the soluble resin patterns 4 may be dissolved. Further, in the dipping and heating process, heating may be performed while effecting the dipping or the heat treatment may be performed after the dipping.

As such a reducing agent, a substance having a reducing action is useful, and, in particular, a compound including copper ions such as copper triflate, copper acetate or copper benzoate is effective. Among these compounds, copper triflate provides a particularly high effect. Further, other than these compounds, ascorbic acid is also effective.

Figure 11A:
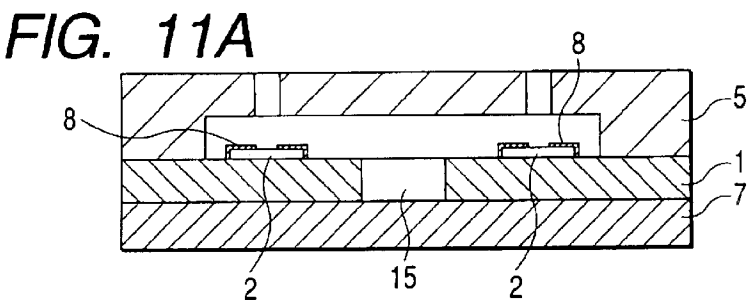
FIGS. 11A and 11B are schematic views showing the substrate on which an ink supplying member has been arranged.
Figure 11B:
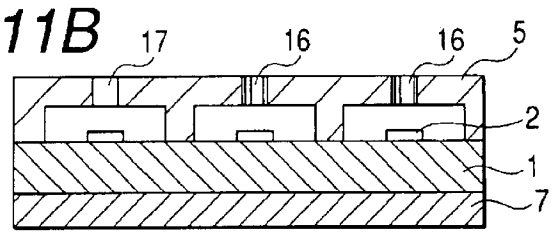

Regarding the substrate in which the ink flow paths and the ink discharge ports were formed, electrical connection for driving the ink supplying member 7 and the ink discharge pressure generating elements is effected, thereby forming the ink jet recording head (FIGS. 11A and 11B).

In the illustrated embodiment, while an example in which the ink discharge ports are formed by the photolithograpy was explained, the present invention is not limited to such an example, but rather the ink discharge ports can be formed by dry etching utilizing oxygen plasma or by excimer laser by changing the mask. When the ink discharge ports are formed by excimer laser or dry etching, since the substrate is protected by the resin patterns not to be damaged by the laser or the plasma, a head having high accuracy and high reliability can be provided. Further, when the ink discharge ports are formed by dry etching or excimer laser, a thermosetting coating resin layer 5 may be used in place of the photosensitive coating resin layer 5.

The ink discharge port 16 used for discharging the ink to effect the recording has an opening area of 190 $\mu m^2$ and 128 ink discharge ports are arranged in a row. Incidentally, the ink discharge port 16 may have any shape other than that shown in FIG. 12, so long as it is optimum for recording, and thus, may have a circular shape, for example.

On the other hand, two circular dummy discharge ports 17 are arranged on each side of the row comprised of 120 discharge ports 16 (four dummy discharge ports in total). Each dummy discharge port has an opening area of 274 to 342 $\mu m^2$, which is greater than 190 $\mu m^2$. The circular dummy discharge ports 17 are not used for effecting the recording but are used for determining an ink discharge amount rank of the recording element substrate 12, as will be described later.

132 electrical/thermal converting elements 14 are arranged in a line with a pitch of 600 DPI to be opposed to the discharge ports 16. Each electrical/thermal converting element serves to discharge ink from the corresponding discharge port 16 by generating a bubble in the ink supplied from the ink supply port 15 by means of the electrical/thermal converting element 14 thereby to effect the recording on a recording medium such as recording paper. However, among the 132 electrical/thermal converting elements 14, although 128 elements except for two elements on both ends (four in total) are driven for effecting the recording on the recording medium, the remaining four elements corresponding to the dummy discharge ports 17 are not driven.

Incidentally, the recording element substrate 12 according to the illustrated embodiment may be designed so that, when the ink is discharged, the bubble formed on each electrical/thermal converting element 14 is communicated with the atmosphere through each discharge port 16.

As shown in FIGS. 12 and 13, although adjacent ink flow paths 13 are partitioned by an ink flow path wall 20, in the illustrated embodiment, the ink flow path walls 20 do not extend up to ends 15*a* of the ink supply port, and a distance between the end 15*a* of the ink supply port and an end 20*a* of the ink flow path wall is selected to be a distance "a". Further, a width of the ink supply port 15 according to the illustrated embodiment is selected to be 100 $\mu$m, and a flow path height L in the ink flow path 13 is 25 $\mu$m and the dimensions of the electrical/thermal converting element 14 are 24 $\mu$m×24 $\mu$m.

Incidentally, in the illustrated embodiment, as mentioned above, while an example in which the distance between the end 15*a* of the ink supply port and the end 20*a* of the ink flow path wall is selected to be "a" was explained, the present invention is not limited to such an example, but the distance "a" may be zero, i.e., the end 20*a* of the ink flow path wall may extend up to the end 15*a* of the ink supply port.

Next, the determination of the discharge amount rank, which ranks a quantity of the ink discharge amount due to individual difference of the recording element substrate 12 caused during the manufacture thereof, will be explained.

In order that an area of the discharge port 16 correspond well to an area of the dummy discharge port 17, it is preferable that the process for forming the discharge port 16 and the process for forming the dummy discharge port 17 be carried out under the same conditions. In the nozzle forming process according to the illustrated embodiment, since the dummy discharge ports 17 are formed simultaneously with the discharge ports 16 under the same conditions by collectively effecting the pattern exposure with respect to the coating resin layer in a wafer condition by means of an MPA device, adequate correspondence between the dummy discharge ports 17 and the discharge ports 16 can be obtained. More specifically, when the diameter of the discharge port 16 is 15.5 $\mu$m, the diameter of the dummy discharge port 17 becomes 19.0 $\mu$m, and a ratio of 15.5:19.0 is always constant. As such, the dummy discharge port area and the discharge port area simultaneously patterned on the same wafer have a proportional relationship.

Figure 15:
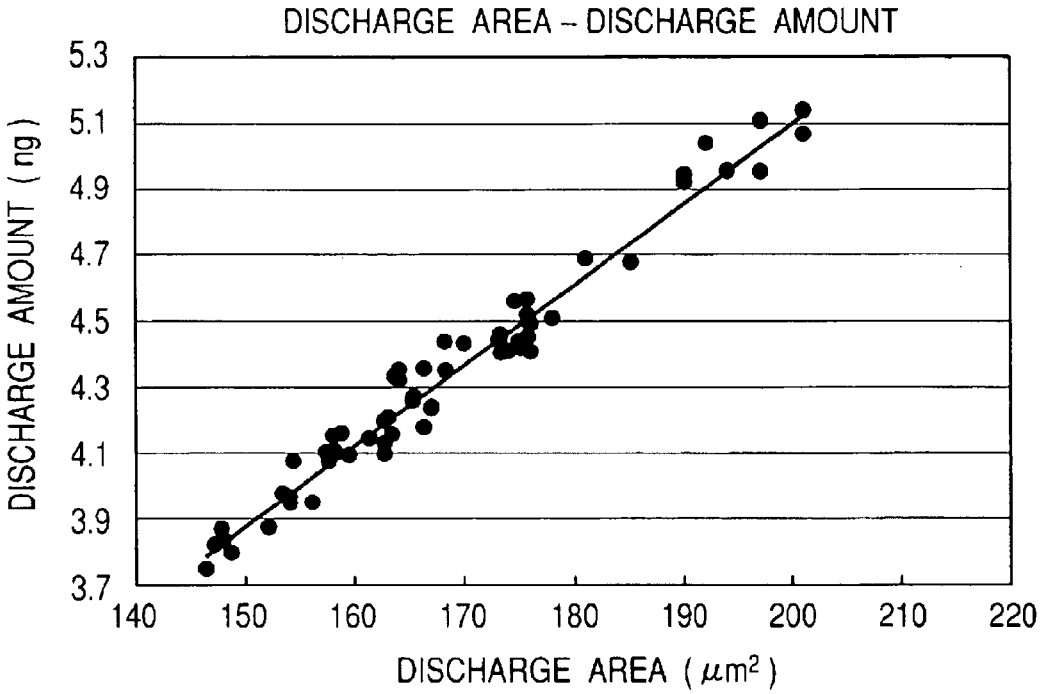
FIG. 15 is a graph showing a relationship between an opening area of the discharge port and a discharge amount of ink discharged from the discharge port.

On the other hand, under a given driving condition, there is a strong relationship between the discharge port area and the ink discharge amount. That is to say, there is a relationship that, when the discharge port area is small, the ink discharge amount becomes little; whereas, when the discharge port area is great, the ink discharge amount becomes large (FIG. 15).

By using this relationship, a recording element substrate 12 according to the illustrated embodiment is assigned one of three rankings, as shown in the following Table 1, on the basis of the opening area of the discharge port 16:

TABLE 1

| | (Discharge port area-Discharge port rank) | |
|---|---|---|
| Vd(ng) | discharge port area ($\mu m^2$) | discharge amount rank |
| 4.0 ≦ Vd < 4.3 | 155 ≦ S < 168 | discharge amount small |
| 4.3 ≦ Vd < 4.7 | 168 ≦ S < 185 | discharge amount middle |
| 4.7 ≦ Vd < 5.0 | 185 ≦ S < 198 | discharge amount great |

That is to say, when the opening area S of the discharge port 16 is 155 $\mu m^2 \leqq S < 168\ \mu m^2$, the ink discharge amount Vd from the discharge port 16 becomes 4.0 ng≦Vd<4.3 ng, and the discharge amount rank in this case is referred to as "discharge amount small"; when the opening area S of the discharge port 16 is 168 $\mu m^2 \leqq S < 185\ \mu m^2$, the ink discharge amount Vd from the discharge port 16 becomes 4.3 ng≦Vd<4.7 ng, and the discharge amount rank in this case is referred to as "discharge amount middle"; and when the opening area S of the discharge port 16 is 185 $\mu m^2 \leqq S < 198\ \mu m^2$, the ink discharge amount Vd from the discharge port 16 becomes 4.7 ng≦Vd<5.0 ng, and the discharge amount rank in this case is referred to as "discharge amount great". Incidentally, more than three discharge amount rankings may be used, and threshold values of the rankings are not limited to the above-mentioned numerical values.

Figure 16:
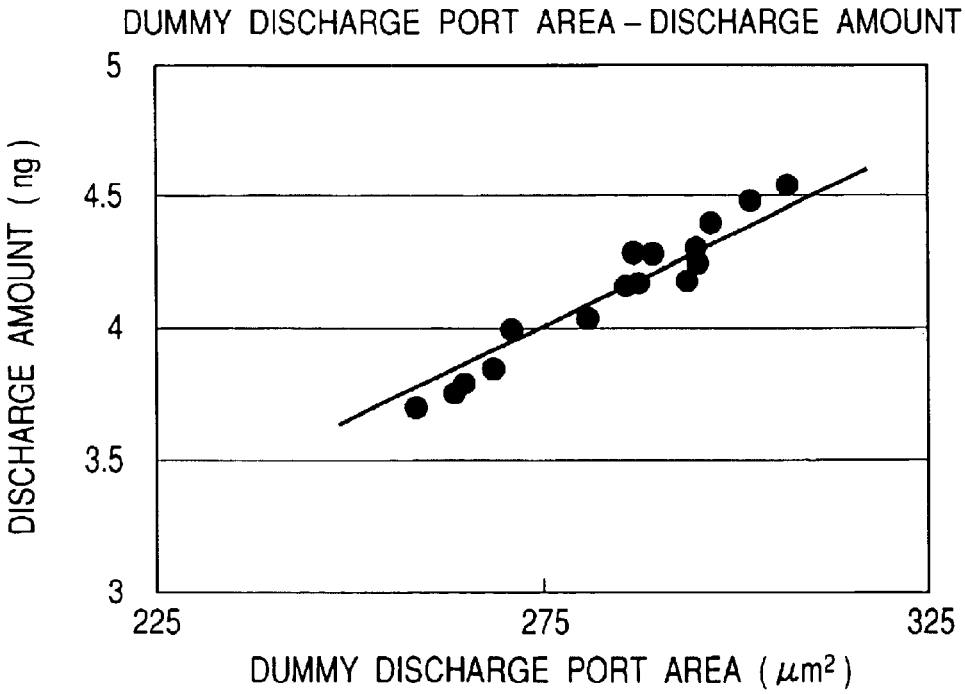
FIG. 16 is a graph showing a relationship between an opening area of a dummy discharge port and a discharge amount of ink discharged from the discharge port.

Further, since the dummy discharge port area and the discharge port area have a proportional relationship, as shown in FIG. 16, in the recording element substrate 12 according to the illustrated embodiment, there is a strong relationship between the opening area of the dummy discharge port 17 which does not discharge the ink and the ink discharge amount from the discharge port 16 which discharges the ink. That is to say, there is a relationship that, when the opening area of the dummy discharge port 17 is small, the ink discharge amount from the discharge port 16 becomes small, whereas, when the opening area of the dummy discharge port 17 is great, the ink discharge amount from the discharge port 16 becomes great.

By using this relationship, the discharge amount rank of a recording element substrate 12 according to the illustrated embodiment can be determined by using a relationship between the opening area of the dummy discharge port 17 and the ink discharge amount from the discharge port 16, as shown in the following Table 2, in a manner similar to the ranking performed by utilizing the above-mentioned relationship between the opening area of the discharge port 16 and the ink discharge amount from the discharge port 16:

TABLE 2

| | (Dummy discharge port area-Discharge port rank) | |
|---|---|---|
| Vd(ng) | dummy discharge port area ($\mu m^2$) | discharge amount rank |
| 4.0 ≦ Vd < 4.3 | 274 ≦ So < 294 | discharge amount small |

TABLE 2-continued

| | (Dummy discharge port area-Discharge port rank) | |
|---|---|---|
| Vd(ng) | dummy discharge port area ($\mu m^2$) | discharge amount rank |
| 4.3 ≦ Vd < 4.7 | 294 ≦ So < 322 | discharge amount middle |
| 4.7 ≦ Vd < 5.0 | 322 ≦ So < 342 | discharge amount great |

That is to say, when the opening area So of the dummy discharge port 17 is 274 $\mu m^2 \leqq So < 294\ \mu m^2$, the ink discharge amount Vd from the discharge port 16 becomes 4.0 ng≦Vd<4.3 ng, and the discharge amount rank in this case is referred to as "discharge amount small"; and when the opening area So of the dummy discharge port 17 is 294 $\mu m^2 \leqq So < 322\ \mu m^2$, the ink discharge amount Vd from the discharge port 16 becomes 4.3 ng≦Vd<4.7 ng, and the discharge amount rank in this case is referred to as "discharge amount middle"; and when the opening area So of the dummy discharge port 17 is 322 $\mu m^2 \leqq So < 342\ \mu m^2$, the ink discharge amount Vd from the discharge port 16 becomes 4.7 ng≦Vd<5.0 ng, and the discharge amount rank in this case is referred to as "discharge amount great".

Figure 17:
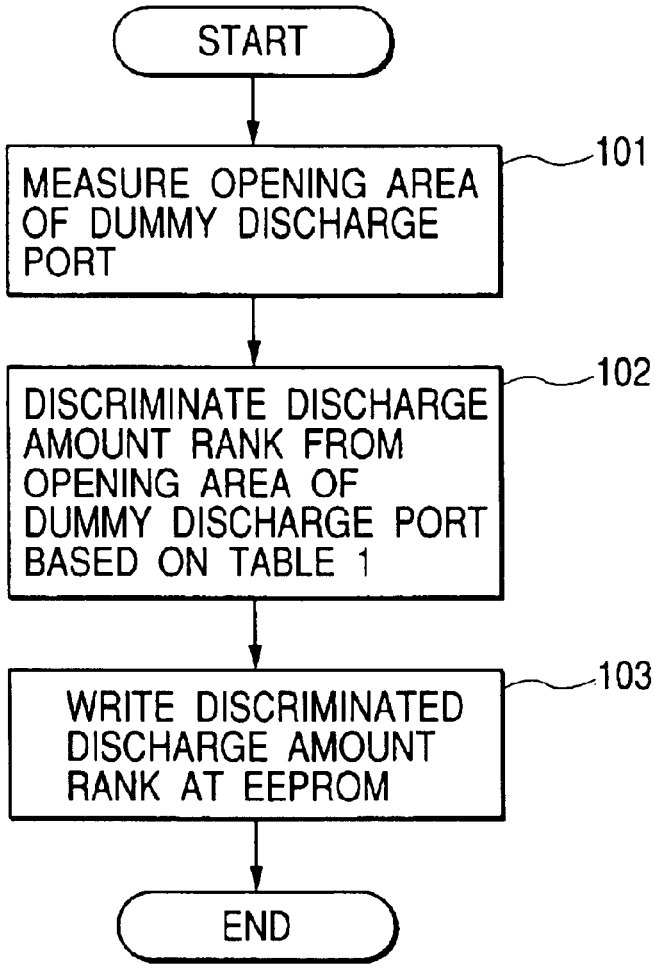
FIG. 17 is a flow chart showing steps for determining the discharge amount rank of the recording element substrate.

FIG. 17 is a flow chart for determining the above-mentioned discharge amount rank of the recording element substrate 12.

First of all, the opening area of the dummy discharge port 17 having the circular opening is measured by image treatment (step 101).

In this case, the measurement of the opening area of the dummy discharge port 17 may be performed for each wafer or may be performed after the head is assembled.

Figure 18A:
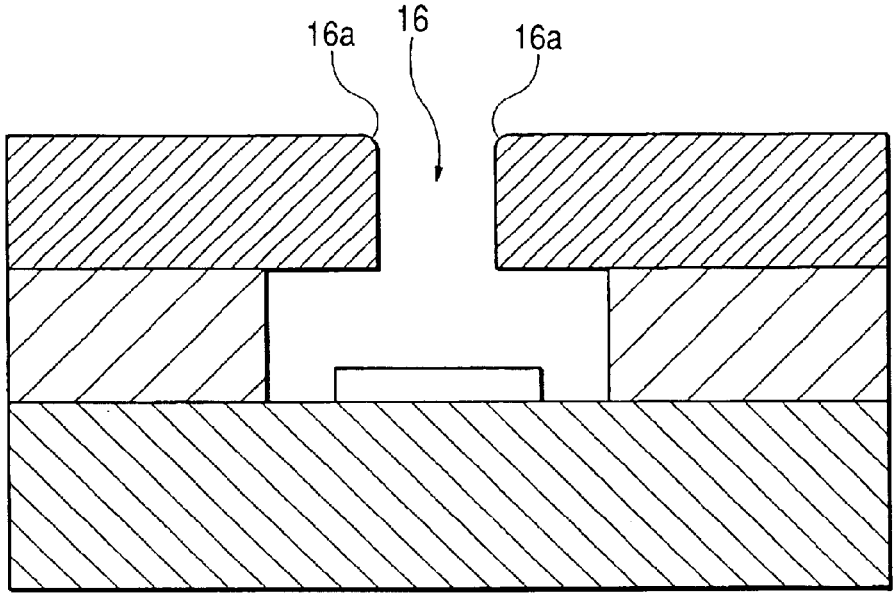
FIGS. 18A and 18B are a sectional side view and a plan view showing an R-configured portion of the discharge port.
Figure 18B:
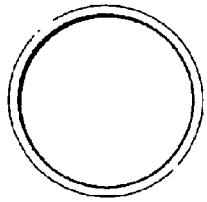

In the measurement of the area, by using a microscope, light is illuminated onto a head face surface 18 (refer to FIG. 12), and an image is taken by a CCD, and lengths of the discharge port in the X direction and the Y direction (refer to FIG. 12) are measured from a result of edge detection, and the measured lengths are converted into the area. However, in a complicated shape such as a star shape of the discharge port 16, although the area cannot be determined only by the edge detection in the X and Y directions and pixels must be counted by binarizing the image of the discharge port 16 taken, as shown in FIG. 18A, which is a sectional view of the discharge port, since the edge portion of the discharge port 16 has an R configuration or chamfer configuration 16*a*, when observed from the front side of the discharge port 16, the edge portion is observed as a double line as shown in FIG. 18B. Thus, accuracy of the binarizing cannot be ensured. Further, since the measuring time should be shortened as much as possible, using a circular shape for the dummy discharge port 17, which can be measured by edge detection, is preferable.

Incidentally, when the area is measured for each wafer, since the variation in etching is distributed substantially uniformly on the wafer, by measuring only several chips (not all of the chips) in consideration of such variation, a representative value of the wafer may be obtained. More specifically, in the water, it is preferable that the opening areas of the dummy discharge ports 17 of a central one chip and four corner chips (five chips in total) are measured and an average value thereof is regarded as the representative value.

When the chip is provided with a function corresponding to a ROM, since the measured data can be written in the chip as it is during the measurement of the wafer, it is preferable that the opening area of the dummy discharge port 17 is measured for each chip. However, if the chip is not provided with a function corresponding to a ROM, it is more preferable that the measurement is effected for each wafer and the representative value is obtained.

On the other hand, when the area is measured after the head is assembled, if the head is filled with ink, the meniscus formed within the discharge port 16 is apt to be influenced by the R configuration 16*a* of the discharge port 16, with the result that variation in the swelled position of the meniscus becomes great so as to hinder correct measurement. Particularly in the case of smaller discharge ports, since the influence of the R configuration 16*a* is apt to be felt, the dummy discharge port 17, which is larger than the discharge port 16, is measured. Further, when the measurement is effected after the filling of ink in consideration of the above, in the measurement performed after printing, it is preferable that the measurement is effected by using the dummy discharge port 17 since mist adheres to the discharge port 16 during printing, which makes measurement difficult.

Now, the reason that the circular dummy discharge port 17 is preferable will be further explained.

When the discharge port 16 and the dummy discharge port 17 are opened or pierced by an exposure device such as MPA, regarding the discharge port 16 and the dummy discharge port 17 formed on the mask, shapes including distortion of image due to aberration can be obtained. Namely, even when the dummy discharge port 17 on the mask is a true circle, the formed dummy discharge port 17 may not be a true circle. However, since the dummy discharge port 17 is circular, the distortion amount can be measured more correctly as compared to a polygon (non-circular shape), and thus, the measuring accuracy of the opening area of the dummy discharge port 17 can be enhanced. That is to say, by dividing interior and exterior of the dummy discharge port 17 from each other by image processing and binarizing, even if the shape of the dummy discharge port 17 deviates from a true circle, the opening area of the dummy discharge port 17 can be measured correctly.

Further, the measurement of the dummy discharge port 17 means that the dummy discharge port 17 having a simpler shape and a greater area than the discharge port 16 is measured, and, thus, more correct measurement can be achieved than would be the case with the discharge port 16.

That is to say, even when the area is hard to be measured, for example, when the discharge port 16 does not have a circular shape but has a star shape as in the illustrated embodiment or a rectangular shape or when a plurality of discharge port areas having different discharge amounts are included in one chip, the measurement can be simplified by providing dummy discharge port 17 with a circular area.

Further, by making the dummy discharge port 17 larger than the discharge port 16, the area tolerance of the discharge port 16 becomes in a range (43 $\mu m^2$) from 155 to 198 $\mu m^2$, whereas the area tolerance of the dummy discharge port 17 becomes in a range (68 $\mu m^2$) from 274 to 342 $\mu m^2$, thereby obtaining a wider margin. By doing so, as the discharge port 16 becomes smaller, it can be avoided that (1) condition margin becomes smaller in order to satisfy the dimensional tolerance in the manufacturing process and (2) the discharge port is apt to be influenced by the measuring accuracy of the discharge port area, and thus, that the dimensional tolerance becomes severe when the discharge port 16 is measured.

In this way, the discharge port 16 is configured to effect the optimum recording, whereas the dummy discharge port 17 is configured to obtain the optimum ranking in terms of the discharge amount rank.

Incidentally, regarding the determination of the discharge amount rank, in the illustrated embodiment, while an example in which the opening area of the dummy discharge port 17 is measured on the basis of the relationship between the opening area of the dummy discharge port 17 and the ink discharge amount was explained, the present invention is not limited to such an example; alternatively, when the relationship between the opening area of the discharge port 16 and the ink discharge amount is known, the opening area of the discharge port 16 may be measured.

In the above-mentioned measurement and ranking, when it is known that the discharge amount varies across manufacturing lots, the dummy discharge port 17 may be measured for each manufacturing lot, thereby seeking a representative lot value. In this case, since it is not required that the opening area of the dummy discharge port 17 be measured for all of the recording element substrates 12, not only can the time for measuring the opening area be shortened but also the working can be simplified. However, the present invention is not limited to the case in which each lot is measured; if necessary, the opening area of the dummy discharge port 17 may be measured for individual recording element substrates 12.

Then, the discharge amount rank of the recording element substrate 12 is determined on the basis of Table 1 (step 102). When the measurement is effected for each lot, the entire lot has the same discharge amount rank.

Then, the discharge amount rank determined in the step 102 is written in the EEPROM 33 (step 103).

Incidentally, the data to be written may be the discharge amount rank such as "discharge amount small", "discharge amount middle" or "discharge amount great" in the Table 2. Alternatively, the opening area of the dummy discharge port 17 or the ink discharge amount corresponding to the opening area of the dummy discharge port 17 based on the relationship shown in FIG. 16 may be written.

Incidentally, in the case of the head collectively including six colors as shown in FIG. 1, when the six colors are associated with the same wafer, only one rank may be stored in the EEPROM 33, whereas, when the six colors are associated with different wafers, plural ranks must be stored in the EEPROM.

Further, it is preferable that a conversion table for effecting conversion between the area of the dummy discharge port 17 and the area of the discharge port 16 be provided for each chip or each color, since the discharge port area may be differentiated by the fact that discharge volumes between six colors may be differentiated due to specification or different wafers.

Incidentally, the numerical values used in the illustrated embodiment are merely an example, and the present invention is not limited to such numerical values.

By writing the discharge amount rank based on the opening area of the dummy discharge port 17 in this way, the opening area of the dummy discharge port 17 or the ink discharge amount in the EEPROM 33, it can be known what discharge property regarding the ink discharge amount is provided by each of the recording element substrates 12 manufactured. Thus, in the ink jet recording apparatus, for example, even if the recording element substrate 12 is exchanged, since the individual difference in discharge amount of the recording element substrate 12 can be determined and the discharge signal suitable for such recording element substrate 12 can be sent to the recording element substrate 12, the problem regarding the variation in recording density between the recording element substrates 12 can be eliminated.

Further, in the ink jet recording apparatus, by reading the discharge amount rank from the EEPROM 33 provided on the ink jet recording head 516, and by changing the driving condition of the ink jet recording head 516 or by increasing or decreasing the number of dots per unit area on the basis of such information thereby to control alignment of density, uniform density and color of the image can be obtained with any head.

As mentioned above, in the present invention, the discharge amount information including at least one of the discharge port area, ink discharge amount and discharge amount rank is written to the memory mounted to the ink jet recording head. Thus, since the variation in discharge amount for each ink jet recording head is not required to be measured by actually discharging the ink, the manufacturing process can be simplified, and, since the recording can be effected on the basis of the discharge signal in accordance with the individual difference, the variation in recording density between the ink jet recording heads can be reduced.

What is claimed is:

1. A method for correcting an ink discharge amount of an ink jet recording head, the ink jet recording head comprising a plurality of ink flow paths to which ink is supplied externally, a plurality of energy generating elements provided in the respective ink flow paths and adapted to generate energy utilized for discharging the ink, and a plurality of discharge ports that are used for recording and that communicate with the respective ink flow paths, the discharge ports being formed by patterning, said method comprising:

a step of providing the ink jet recording head with a dummy discharge port having a dummy discharge opening that has a circular shape and a cross-sectional area greater than that of discharge openings of the plurality of discharge ports, the dummy discharge port not being used for recording, and the plurality of discharge ports and the dummy discharge port being formed in the same step;

a measuring step for measuring the cross-sectional area of the dummy discharge opening;

a step of writing discharge amount information, which is determined in relation to the measured cross-sectional area of the dummy discharge opening, in a memory mounted to the ink jet recording head; and a step of varying an ink discharge amount to be discharged from the discharge ports used for recording, as needed, on the basis of the discharge amount information written in the memory mounted to the ink jet recording head.

2. A method according to claim 1, wherein the ink jet recording head is manufactured in lots, and said measuring step is performed for each manufacturing lot of ink jet recording heads.

3. A method according to claim 1, wherein said measuring step is performed for each ink jet recording head to be manufactured.

4. A method according to claim 1, wherein a shape of said discharge ports that are used for recording is a shape other than a circular shape.

5. A method according to claim 1, wherein a correlation between the cross-sectional area of the dummy discharge opening and the ink discharge amount is preliminarily obtained, and then, on the basis of the correlation, the ink discharge amount to be discharged from the discharge ports used for recording is determined from the measured cross-sectional area of the dummy discharge opening.

6. A method according to claim 1, wherein a correlation between the cross-sectional area of the dummy discharge opening and the ink discharge amount is preliminarily obtained, ranks are established indicating different magnitudes of the ink discharge amount to be discharged from the discharge ports used for recording, and then, using the correlation, a rank is assigned to the ink jet recording head based on the measured cross-sectional area of the dummy discharge opening, the rank indicating a magnitude of the ink discharge amount for the ink jet recording head.

* * * * *